US011550245B1

(12) United States Patent
Himeno

(10) Patent No.: US 11,550,245 B1
(45) Date of Patent: Jan. 10, 2023

(54) IMAGE FORMING APPARATUS

(71) Applicant: Toshiba Tec Kabushiki Kaisha, Tokyo (JP)

(72) Inventor: Satoshi Himeno, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/691,005

(22) Filed: Mar. 9, 2022

(51) Int. Cl.
*G03G 15/20* (2006.01)
*G03G 15/00* (2006.01)

(52) U.S. Cl.
CPC ..... *G03G 15/2028* (2013.01); *G03G 15/2064* (2013.01); *G03G 15/5008* (2013.01); *G03G 15/657* (2013.01)

(58) Field of Classification Search
CPC ..... G03G 15/2028; G03G 15/2064; G03G 15/5008; G03G 15/657
See application file for complete search history.

(56) References Cited

U.S. PATENT DOCUMENTS

| | | | | |
|---|---|---|---|---|
| 11,269,277 | B1 * | 3/2022 | Taki | G03G 15/5008 |
| 2008/0107436 | A1 | 5/2008 | Mikutsu | |
| 2018/0213100 | A1 * | 7/2018 | Wu | B65H 1/14 |
| 2020/0033782 | A1 * | 1/2020 | Sugai | G03G 15/5029 |

FOREIGN PATENT DOCUMENTS

| | | | | |
|---|---|---|---|---|
| JP | 2005-202174 | A | 7/2005 | |
| JP | 2005-326702 | A | 11/2005 | |
| JP | 2007-206204 | A | 8/2007 | |
| JP | 4343036 | B2 * | 10/2009 | |
| JP | 2012-155256 | A | 8/2012 | |
| JP | 2015-200731 | A | 11/2015 | |
| JP | 2017-040801 | A | 2/2017 | |
| JP | 2017058640 | A * | 3/2017 | |
| JP | 2021026084 | A * | 2/2021 | B65H 5/062 |

* cited by examiner

*Primary Examiner* — Sevan A Aydin
(74) *Attorney, Agent, or Firm* — Foley & Lardner LLP

(57) ABSTRACT

An image forming apparatus includes a sheet storage, a sheet feed roller, an image forming device, a fixing device, a motor, a sensor, and a controller having a processor. The sheet storage is configured to store a sheet. The sheet feed roller is configured to feed the sheet stored in the sheet storage into the conveyance path. The image forming device is configured to form an image on the sheet. The fixing device includes a fixing belt and a pressure roller abutting on an outside of the fixing belt, and is configured to fix the image formed on the sheet. The motor is configured to drive and rotate the fixing belt by rotating the pressure roller. The sensor is configured to measure the drive current in the motor. The processor is configured to control a conveyance speed of the sheet based on the measured drive current.

13 Claims, 12 Drawing Sheets

IMAGE FORMING APPARATUS

FIELD

Embodiments described herein relate generally to an image forming apparatus.

BACKGROUND

In recent years, many fixing devices installed in image forming apparatuses have a configuration that slides inside the fixing belt for the purpose of energy saving. Therefore, troubles that cause sliding failures due to manufacturing defects and component defects are increasing. If a sliding failure occurs, a sheet conveyance failure occurs accordingly. As a result, defects such as sheet wrinkles of the sheet may occur due to the conveyance failure of the sheet, which may lead to the deterioration of the quality.

DETAILED DESCRIPTION

In general, according to one embodiment, the image forming apparatus includes a sheet storage, a sheet feed roller, an image forming device, a fixing device, a motor, a sensor, and a controller having a processor. The sheet storage is configured to store sheets. The sheet feed roller is configured to feed a sheet stored in the sheet storage into the conveyance path. The image forming device is configured to form an image on the sheet conveyed to the conveyance path. The fixing device is configured to fix the image formed on the sheet and includes a fixing belt and a pressure roller abutting on an outside of the fixing belt, the fixing belt being a strip-shaped thin film. The motor is configured to drive and rotate the fixing belt by rotating the pressure roller. The sensor is configured to measure the drive current in the motor. The processor of the controller is configured to control a conveyance speed of the sheet based on the measured drive current.

Hereinafter, exemplary embodiments of the image forming apparatus will be described with reference to the drawings.

First Embodiment

Figure 1:
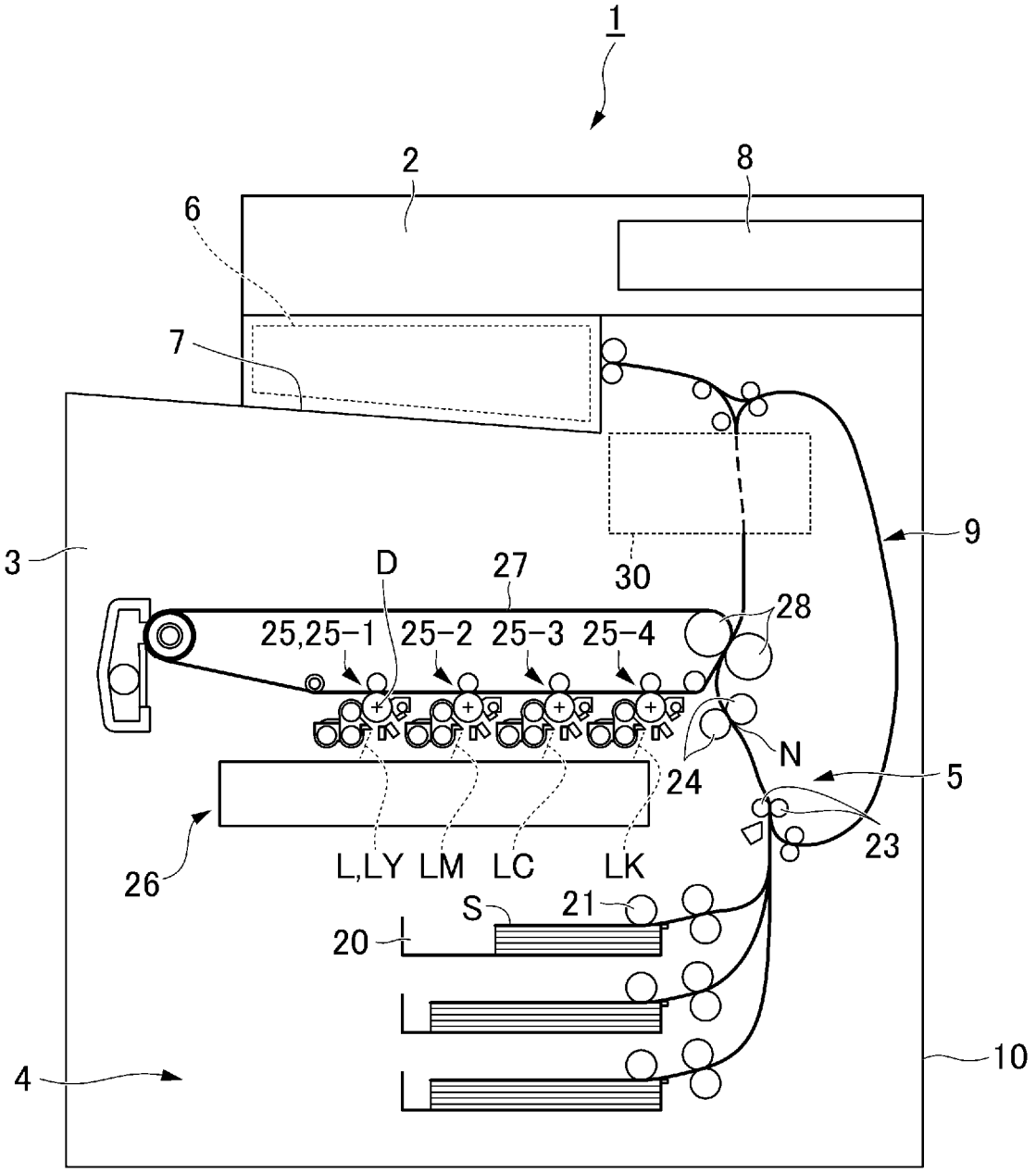
FIG. 1 is a schematic configuration diagram of an image processing apparatus, according to an exemplary embodiment.

FIG. 1 is a schematic configuration diagram of an image processing apparatus according to a first embodiment. The image processing apparatus in the first embodiment is an image forming apparatus 1. The image forming apparatus 1 performs a process of forming an image on a sheet S. The sheet S is, for example, paper, label paper, or the like. The sheet S may be any sheet S as long as the image forming apparatus 1 can form an image on the surface thereof.

The image forming apparatus 1 includes a housing 10, a scanner unit 2, an image forming unit 3, a sheet supply unit 4, a conveyance unit 5, a control unit 6, a sheet discharge tray 7, a control panel 8, and a reversing unit 9.

The housing 10 forms the outer shape of the image forming apparatus 1.

The scanner unit 2 reads the image information of the object to be copied based on brightness and darkness and generates an image signal. The scanner unit 2 outputs the generated image signal to the image forming unit 3.

The image forming unit 3 forms an output image (hereinafter referred to as "toner image") with a recording agent such as toner based on the image signal input from the scanner unit 2 or the image signal input from the outside. The image forming unit 3 transfers the toner image to the surface of the sheet S. The image forming unit 3 heats and pressurizes the toner image transferred to the surface of the sheet S to fix the toner image on the sheet S. Details of the image forming unit 3 will be described later.

The sheet supply unit 4 supplies the sheet S to the conveyance unit 5 one by one at a time when the image forming unit 3 forms the toner image. The sheet supply unit 4 includes a sheet storage unit 20 and a pickup roller 21.

The sheet storage unit 20 stores sheets S of a predetermined size and type.

The pickup roller 21 picks up the sheets S one by one from the sheet storage unit 20. The pickup roller 21 supplies the picked-up sheet S to the conveyance unit 5. The pickup roller 21 is one aspect of the sheet feed roller. Not only is the sheet S stored in the sheet storage unit 20, but the sheet S may also be manually inserted into the image forming apparatus 1 and used as the sheet S on which the image is to be formed.

The conveyance unit 5 conveys the sheet S supplied from the sheet supply unit 4 to the image forming unit 3. The conveyance unit 5 includes a conveyance roller 23 and registration rollers 24.

The conveyance roller 23 conveys the sheet S supplied from the pickup roller 21 to the registration roller 24. The conveyance roller 23 abuts a leading end of the sheet S in a conveyance direction on a nip N of the registration rollers 24.

The registration rollers 24 bend the sheet S at the nip N to adjust a position of the leading end of the sheet S in the conveyance direction. The registration rollers 24 convey the sheet S according to the time at which the image forming unit 3 transfers the toner image to the sheet S.

The image forming unit 3 will be described.

The image forming unit 3 includes a plurality of image forming units 25, a laser scanning unit 26, an intermediate transfer belt 27, a transfer unit 28, and a fixing device 30.

The image forming unit 25 includes a photoconductor drum D. The image forming unit 25 forms a toner image corresponding to the image signal from the scanner unit 2 or the outside on the photoconductor drum D. In at least one embodiment, the plurality of image forming units 25 (image forming units 25-1, 25-2, 25-3, and 25-4) form toner images with yellow, magenta, cyan, and black toners, respectively.

A charger, a developing device, and the like are arranged around the photoconductor drum D. The charger charges the surface of the photoconductor drum D. In some embodiments, the developing device contains a developer containing yellow, magenta, cyan, and black toners. The developing device develops an electrostatic latent image on the photoconductor drum D. As a result, a toner image of toner of each color is formed on the photoconductor drum D.

The laser scanning unit 26 scans the laser light L on the charged photoconductor drum D to expose the photoconductor drum D. In the laser scanning unit 26, the photoconductor drum D of the image forming unit 25 (image forming unit 25-1, 25-2, 25-3, and 25-4) of each color is exposed with different laser light (laser light LY, LM, LC, and LK). As a result, the laser scanning unit 26 forms an electrostatic latent image on the photoconductor drum D.

The toner image on the surface of the photoconductor drum D is primarily transferred to the intermediate transfer belt 27.

The transfer unit 28 transfers the toner image primarily transferred onto the intermediate transfer belt 27 onto the surface of the sheet S at the secondary transfer position.

The fixing device 30 heats and pressurizes the toner image transferred to the sheet S to fix the toner image on the sheet S.

The sheet S on which the image is formed and discharged is placed on the sheet discharge tray 7.

The control panel 8 inputs and displays information for operating the image forming apparatus 1. The control panel 8 includes a touch panel or various hard keys. The control panel 8 is an aspect of a display unit that displays information.

The reversing unit 9 inverts the sheet S in order to form an image on a back surface of the sheet S. The reversing unit 9 reverses the sheet S discharged from the fixing device 30 by switchback. The reversing unit 9 conveys the flipped sheet S toward the registration rollers 24.

The control unit 6 controls each unit of the image forming apparatus 1.

Figure 2:
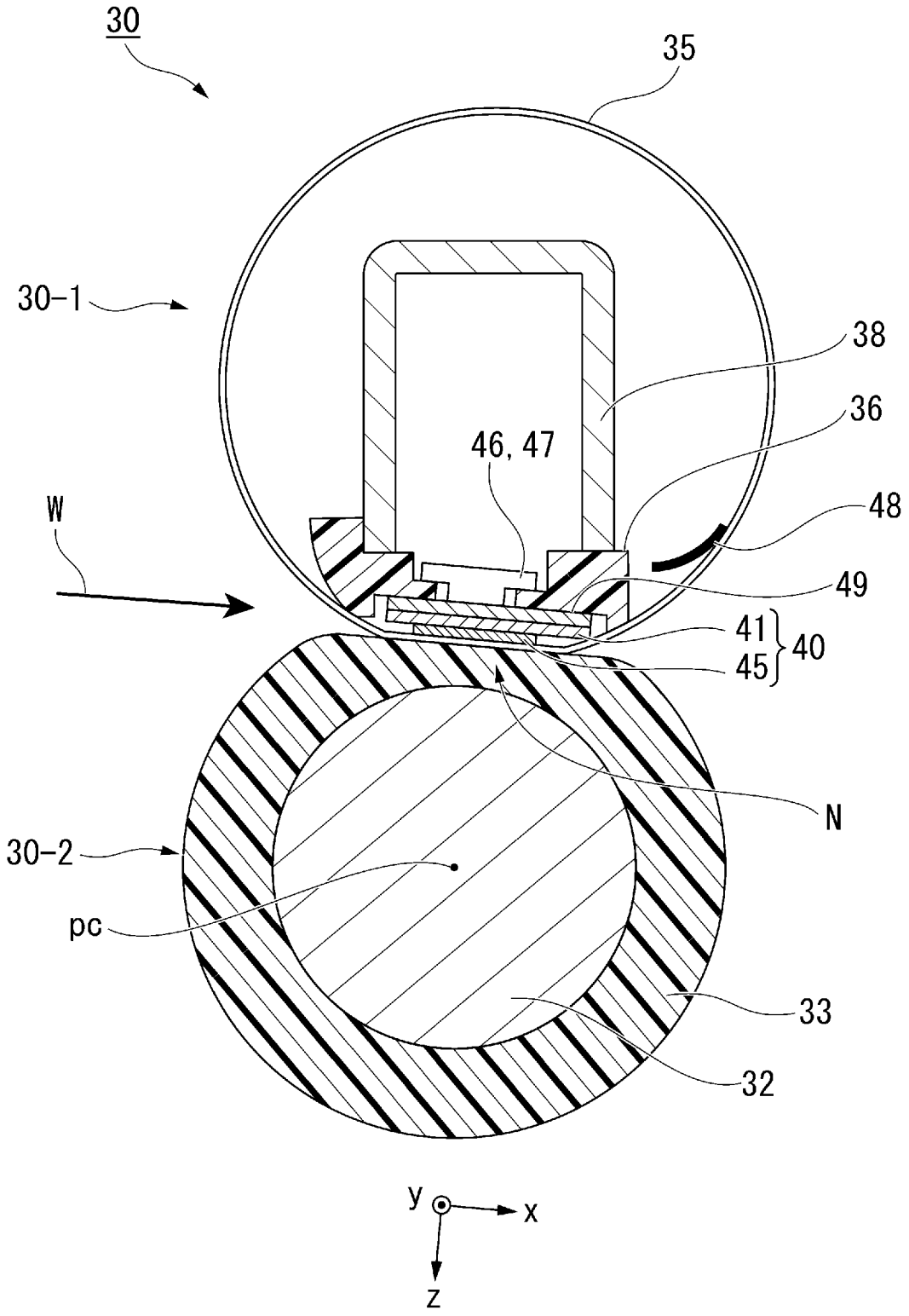
FIG. 2 is a diagram showing an example of a fixing device of the image processing apparatus of FIG. 1.

The fixing device 30 will be described in detail. FIG. 2 is a diagram showing an example of the fixing device 30 according to the first embodiment. The fixing device 30 includes a pressure roller 30-2 and a film unit 30-1.

In the present application, the z direction, the x direction, and the y direction are defined as follows. The z direction is a direction in which the film unit 30-1 and the pressure roller 30-2 are lined up. The +z direction is a direction from the film unit 30-1 toward the pressure roller 30-2. The x direction is a direction extending in the sheet conveyance direction at the nip N, and the +x direction is a direction extending towards a downstream side of the sheet conveyance direction. The y direction is a direction parallel with a central axis direction of the pressure roller 30-2.

The pressure roller 30-2 forms the nip N with the film unit 30-1. The pressure roller 30-2 pressurizes the toner image formed on the surface of the sheet S that entered the nip N. The pressure roller 30-2 rotates on its axis to convey the sheet S. The pressure roller 30-2 includes a core metal 32, an elastic layer 33, and a release layer 34.

In some embodiments, the core metal 32 is formed in a columnar shape by a metal material such as stainless steel. Both ends of the core metal 32 in the y direction are rotatably supported. The core metal 32 is rotationally driven by a motor 69. If the core metal 32 is rotationally driven, the pressure roller 30-2 is rotated and the tubular film 35 (e.g., a fixing belt, etc.) is rotationally driven. The core metal 32 comes into contact with a cam follower 67. The cam follower 67 rotates to bring the core metal 32 closer to and away from the film unit 30-1.

In some embodiments, the elastic layer 33 is formed of an elastic material such as silicone rubber. The elastic layer 33 is formed on an outer peripheral surface of the core metal 32 with a constant thickness.

In some embodiments, the release layer 34 is formed of a resin material such as PFA (tetrafluoroethylene/perfluoroalkyl vinyl ether copolymer). The release layer 34 is formed on an outer peripheral surface of the elastic layer 33.

For example, it is preferable that if an outer diameter of the pressure roller 30-2 is approximately 20 [mm] to 40 [mm], inclusive, an outer diameter of the core metal 32 is set to approximately, 10 [mm] to 20 [mm], inclusive, the thickness of the elastic layer 33 is set to approximately 5 [mm] to 20 [mm], inclusive, and the thickness of the release layer 34 is set to approximately 20 [μm] to 40 [μm], inclusive.

In some embodiments, it is desirable that a hardness of the outer peripheral surface of the pressure roller 30-2 is approximately 40° to 70°, inclusive, under a load of approximately 9.8 [N] as measured by, for example, an ASKER-C hardness tester. In this way, formation of the nip N is facilitated and durability of the pressure roller 30-2 is improved.

The pressure roller 30-2 can approach and separate from the film unit 30-1 by rotating the cam follower 67. If the pressure roller 30-2 is brought close to the film unit 30-1 and pressed by the pressure spring, the nip N is formed. On the other hand, if the sheet S is jammed in the fixing device 30, the sheet S can be easily removed by separating the pressure roller 30-2 from the film unit 30-1. While the tubular film 35 is stopped from rotating, such as during sleep, the pressure roller 30-2 is separated from the film unit 30-1, thereby preventing plastic deformation (e.g., creep, etc.) of the pressure roller 30-2 and the tubular film 35.

The pressure roller 30-2 is rotationally driven by a motor 69 around a pressure roller rotation center pc. If the pressure roller 30-2 rotates on its pressure roller rotation center pc while the nip N is formed, the tubular film 35 of the film unit 30-1 is rotationally driven. The pressure roller 30-2 rotates on its pressure roller rotation center pc in a state where the sheet S is arranged on the nip N and the sheet S is conveyed in the conveyance direction W.

The film unit 30-1 heats the toner image of the sheet S that entered the nip N. The film unit 30-1 includes the tubular film 35 (e.g., cylindrical body, etc.), a heater unit 40, a support member 36, a stay 38, a heater thermometer 46, a thermostat 47, and a film thermometer 64.

The tubular film 35 (e.g., fixing belt, etc.) is formed in a tubular shape. In some embodiments, the tubular film 35 includes a base layer, an elastic layer, and a release layer, in this order, layered on an inner peripheral side of film unit 30-1. In some embodiments, the base layer is formed in a tubular shape by a material such as nickel (Ni). The elastic layer is laminated and arranged on an outer peripheral surface of the base layer. The elastic layer is formed of an elastic material such as silicone rubber. The release layer is laminated and arranged on an outer peripheral surface of the elastic layer. The release layer is formed of a material such as PFA resin.

The heater unit 40 includes a substrate 41 (e.g., heating element substrate, etc.) and a heating element set 45. In some embodiments, the substrate 41 is formed of a metal material such as stainless steel or a ceramic material such as aluminum nitride. The substrate 41 is formed in the shape of an elongated rectangular plate. The substrate 41 is arranged inside the tubular film 35 in a radial direction (e.g., the x direction, etc.) The substrate 41 has a axial direction (e.g., the y direction, etc.) of the tubular film 35 as a longitudinal direction.

The heating element set 45 is arranged on the substrate 41. In some embodiments, the heating element set 45 is formed of a silver/palladium alloy or the like. The heating element set 45 has a heat generating portion that generates heat when energized.

In some embodiments, the support member 36 is formed of a resin material such as a liquid crystal polymer. The support member 36 supports the heater unit 40 via a heat transfer member 49.

In some embodiments, the stay 38 is formed of a steel plate material or the like. The stay 38 is used to support the film unit 30-1.

The heater thermometer 46 is, for example, a thermistor. The heater thermometer 46 measures a temperature of the heater unit 40 via the heat transfer member 49.

The thermostat 47 cuts off energization to the heating element set 45 if the temperature of the heater unit 40 detected via the heat transfer member 49 exceeds a predetermined temperature.

The film thermometer 64 is arranged inside the tubular film 35. The film thermometer 64 contacts the inner peripheral surface of the tubular film 35 and measures the temperature of the tubular film 35.

Figure 3:
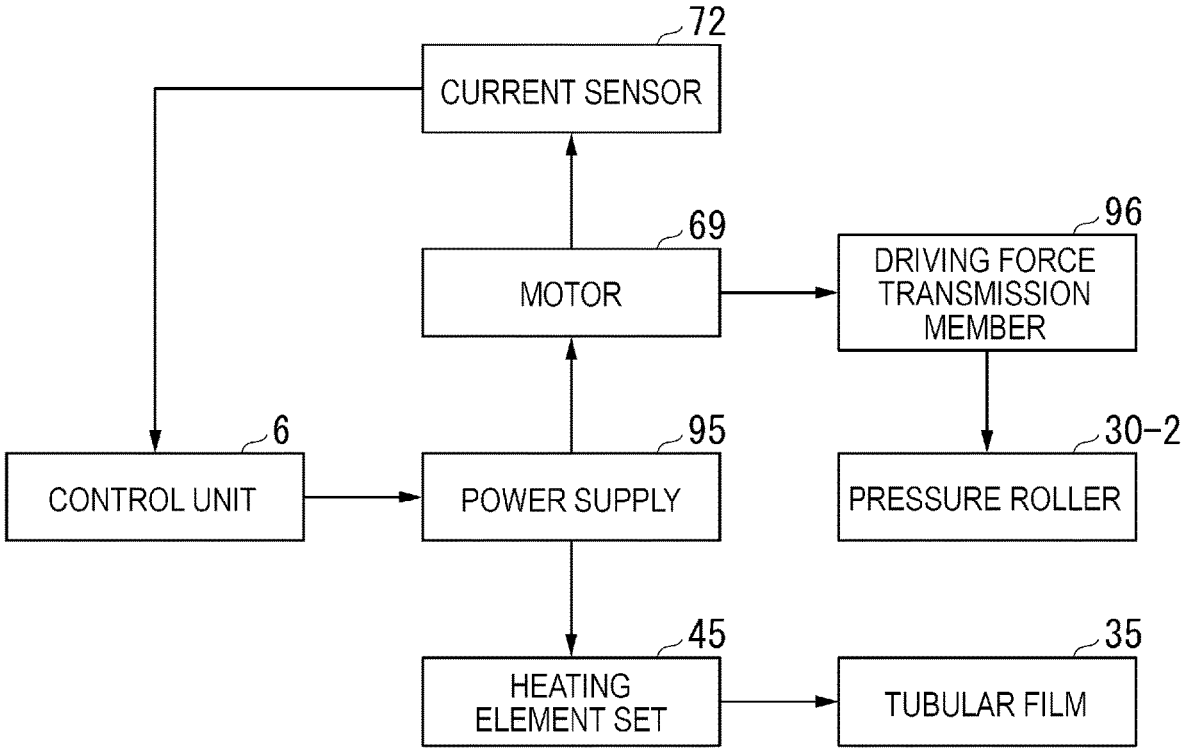
FIG. 3 is a block diagram showing a heating control by the fixing device of FIG. 2.

FIG. 3 will be used to describe the heating control by the fixing device 30 in the first embodiment. FIG. 3 is a block diagram of the heater unit 40 used for the heating control described below, without other components of the image forming apparatus 1.

A power supply 95 supplies electric power to the heating element set 45. The heating element set 45 heats the tubular film 35. The power supply 95 supplies electric power to a motor 69. The motor 69 is, for example, a brushless DC motor. The power generated by the power-supplied motor 69 is transmitted to a driving force transmission member 96. The driving force transmission member 96 is, for example, a driving gear.

The driving force transmission member 96 converts the power transmitted from the motor 69 into a rotational force for rotating the pressure roller 30-2 and rotates the pressure roller 30-2. The pressure roller 30-2 is applied with the rotational force from the driving force transmission member 96 and is rotationally driven, for example, in a clockwise direction at a predetermined speed.

The tubular film 35 comes into contact with the pressure roller 30-2. In the nip N formed by the contact between the tubular film 35 and the pressure roller 30-2, a frictional force acts as the pressure roller 30-2 is rotationally driven. Due to the frictional force in the nip N, a rotational force due to the driven action acts on the tubular film 35. For example, a pressure of a pressure spring may be set so that the pressure contact force between the tubular film 35 and the pressure roller 30-2 has a total pressure of approximately 300 to 500 Newtons.

A current sensor 72 measures a drive current of the motor 69. The current sensor 72 measures the drive current, for example, on a control board of the motor 69. The current sensor 72 outputs information indicating a measurement result to the control unit 6. The measurement result is, for example, the current value of the drive current of the motor 69.

The control unit 6 acquires information indicating the measurement result of the drive current of the motor 69 output from the current sensor 72. The control unit 6 controls a conveyance speed of the sheet S based on the information indicating the measurement result of the drive current of the motor 69. If the current value indicating the measurement result of the drive current is equal to or higher than a threshold value, the control unit 6 controls the conveyance speed to change from a first conveyance speed in a normal state to a second conveyance speed, which is a speed slower than the first conveyance speed so that the sheet S is conveyed at the second conveyance speed. In some embodiments, the second conveyance speed is less than or equal to approximately percent, inclusive, of the first conveyance speed.

The control unit 6 further outputs a notification as an alert if the current value indicating the measurement result of the drive current is equal to or higher than the threshold value. The notification of the alert may be, for example, the control unit 6 causing the control panel 8 to transmit a signal to an external device via a network or displaying information on a call guidance of an operator inspecting the image forming apparatus 1. If the user inputs a call instruction according to the information of the call guidance, the control unit 6 notifies the device related to the operator of the alert.

The current value of the drive current of the motor 69 correlates with a drive torque of the motor 69. As a result, the control unit 6 can estimate the drive torque of the motor 69 from a value based on the measured current value of the drive current. In some embodiments, the value based on the current value of the drive current also includes the current value of the drive current itself. In some embodiments, the value based on the current value of the drive current may be a value such as the drive torque of the motor 69, which is converted from the current value of the drive current.

For example, if the current value of the drive current of the motor 69 is too high, it is presumed that the drive torque is too large and that the remaining amount of the lubricant is low. For example, if the current value of the drive current of the motor 69 is too low, it is presumed that the drive torque is too small and that a contact failure between the tubular film 35 and the pressure roller 30-2 occurred.

If the heating element set 45 is heating the tubular film 35 and the rotation of the tubular film 35 is stopped, a temperature in the vicinity of the heating element set 45 rises sharply. This is, for example, because the sheet S does not pass between the tubular film 35 and the pressure roller 30-2 due to the rotation stoppage of the tubular film 35. Further, because the heating element set 45 is heating the tubular film 35 and the rotation of the tubular film 35 is stopped, heat is not applied to the sheet S. The rotation stoppage of the tubular film 35 mainly occurs due to a decrease in the remaining amount of the lubricant or a contact failure between the tubular film 35 and the pressure roller 30-2. If the temperature in the vicinity of the heating element set 45 rises sharply, the tubular film 35 or the like may be damaged.

As described above, if the rotation of the tubular film 35 is stopped due to a decrease in the remaining amount of the lubricant, the drive torque of the motor 69 becomes larger than that in the normal state. As a result, the current value of the drive current measured by the current sensor 72 becomes larger than that in the normal state.

On the other hand, if the rotation of the tubular film 35 is stopped due to a contact failure between the tubular film 35 and the pressure roller 30-2, the drive torque of the motor 69 becomes smaller than that in the normal state. As a result, the current value of the drive current measured by the current sensor 72 becomes smaller than that in the normal state.

Figure 4:
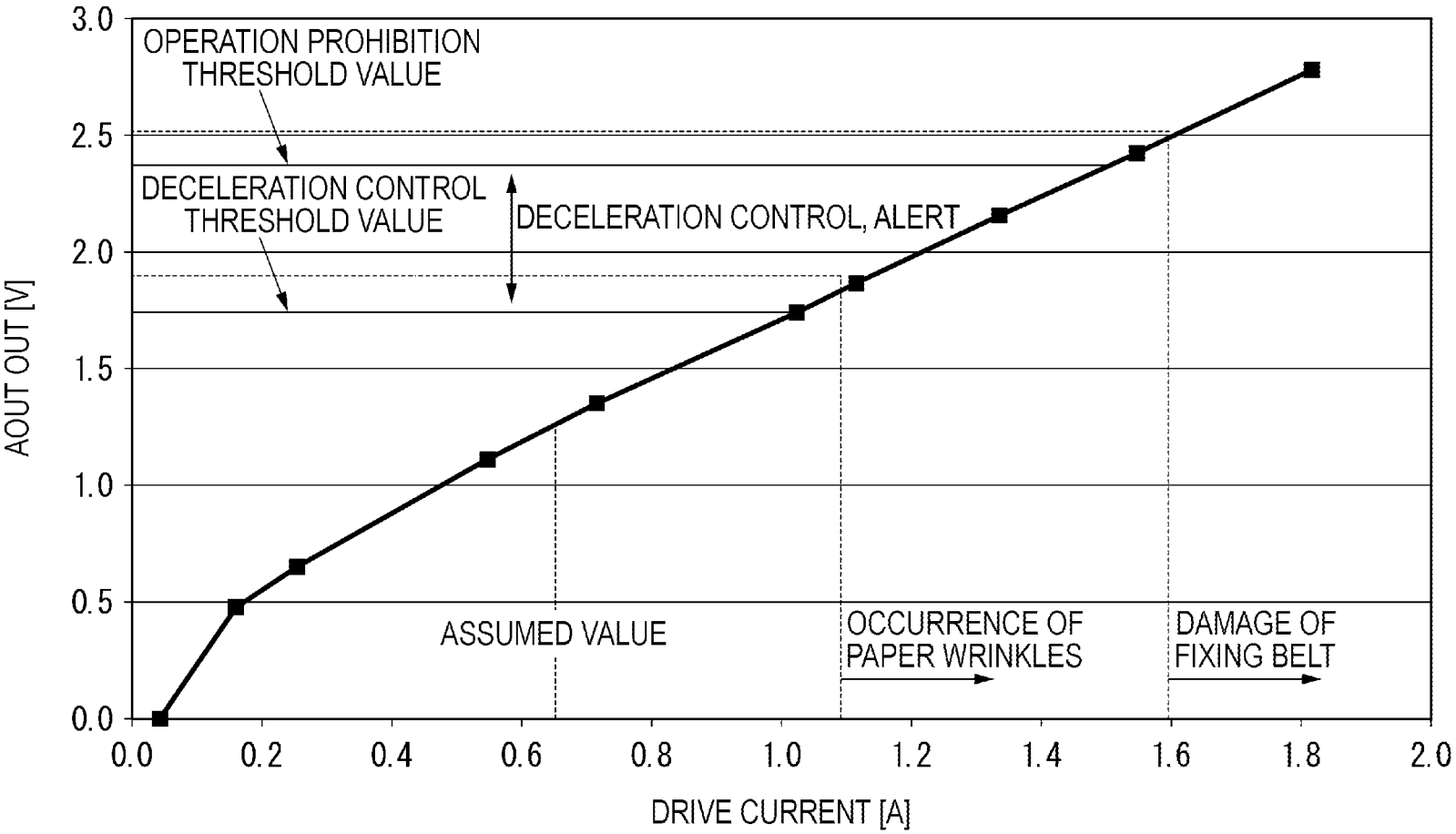
FIG. 4 is a diagram showing a relationship between the drive current of a motor and an output value, according to an exemplary embodiment.

FIG. 4 is a diagram showing a relationship between the drive current of the motor 69 and the output value in the first embodiment. As shown in FIG. 4, as the drive current of the motor 69 increases, sheet wrinkles of the sheet S occur, which eventually leads to damage of the tubular film 35 (e.g., fixing belt, etc.). If the sheet S is conveyed in the fixing device 30, a conveyance load for the conveying force is generated in a direction opposite to the conveyance direction of the sheet S. The conveyance load increases as the conveyance speed of the sheet S increases. If the conveyance load increases, the drive current of the motor 69 increases in order to convey the sheet S. As a result, the problems described above can occur. In the image forming apparatus 1 according to the first embodiment, in order to reduce defects such as sheet wrinkles on the sheet S due to the conveyance failure of the sheet S, as described above, the conveyance speed of the sheet S is controlled based on the information indicating the measurement result of the drive current of the motor 69.

The control unit 6 stores in advance a threshold value for controlling the conveyance speed ("deceleration control threshold value" in FIG. 4). This threshold value is a threshold value indicating an upper limit value of a value based on the current value of the drive current of the motor 69.

Figure 5:
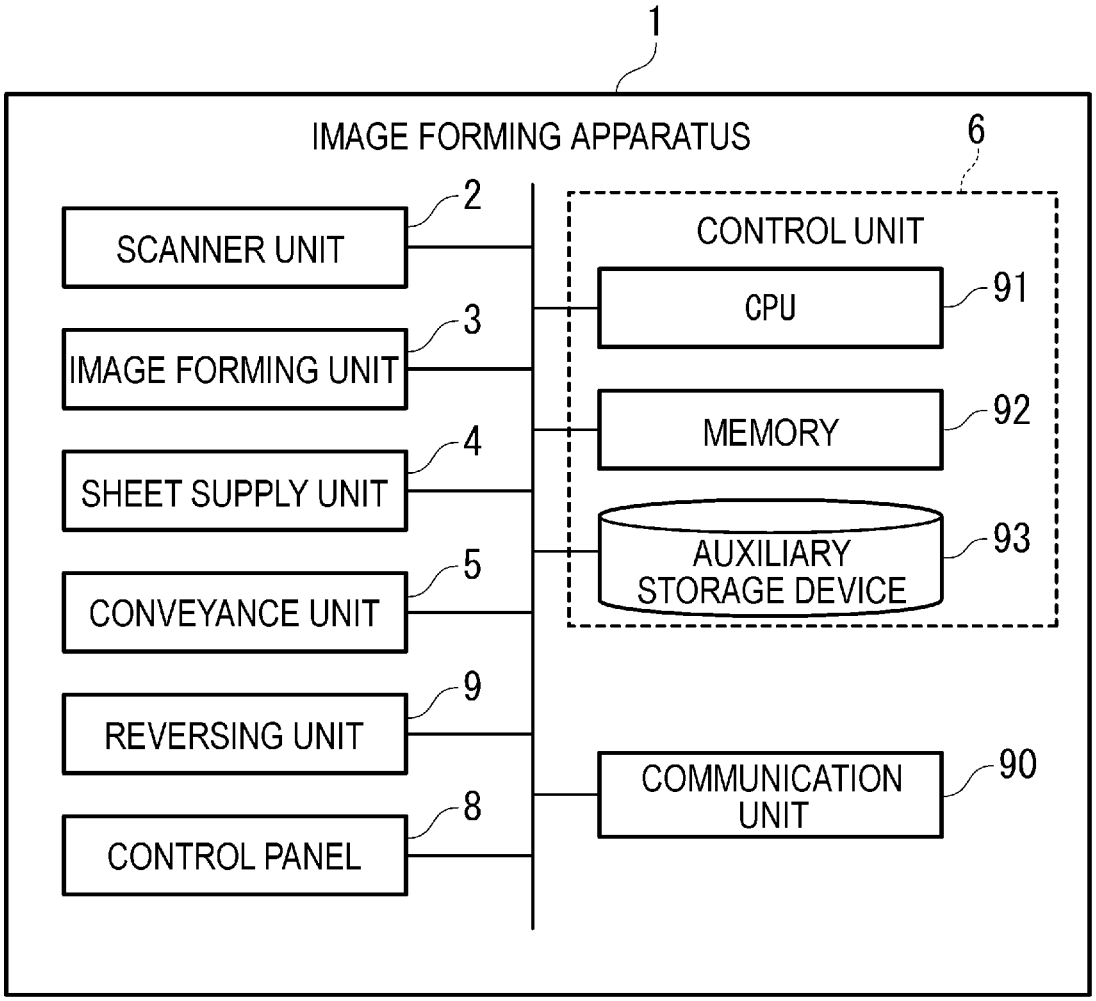
FIG. 5 is a block diagram of the image forming apparatus, according to an exemplary embodiment.

FIG. 5 is a block diagram of the image forming apparatus according to the first embodiment. The image forming apparatus 1 includes a Central Processing Unit (CPU) 91 (e.g., a processor, etc.), a memory 92, an auxiliary storage device 93, and the like connected by a bus, and executes a program. The image forming apparatus 1 functions as an apparatus including the scanner unit 2, the image forming unit 3, the sheet supply unit 4, the conveyance unit 5, the reversing unit 9, the control panel 8, and a communication unit 90 by executing the program.

The CPU 91 functions as the control unit 6 by executing a program stored in the memory 92 and the auxiliary storage device 93. The control unit 6 controls the operation of each functional unit of the image forming apparatus 1. The memory 92 temporarily stores the data used by each functional unit included in the image forming apparatus 1. For example, the memory 92 may temporarily store the image signal, the job, and the job log read by the scanner unit 2. The memory 92 is, for example, a Random Access Memory (RAM).

The auxiliary storage device 93 is configured by using a storage device such as a magnetic hard disk device or a semiconductor storage device. The auxiliary storage device 93 stores information.

The communication unit 90 includes a communication interface for connecting the image forming apparatus 1 to an external device. The communication unit 90 communicates with the external device via the communication interface.

Figure 6:
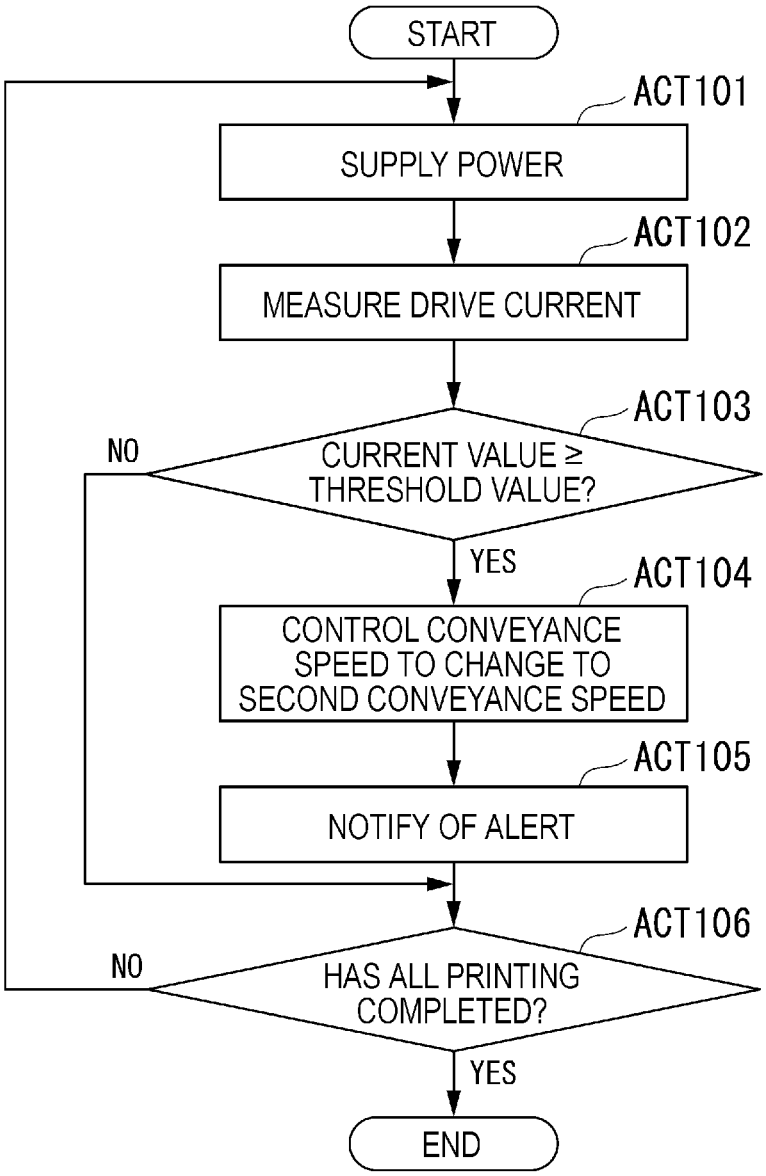
FIG. 6 is a flowchart depicting a method for controlling the image forming apparatus, according to an exemplary embodiment.

FIG. 6 is a flowchart depicting a method for controlling the image forming apparatus 1 in the first embodiment. The method of FIG. 6 is executed if a printing instruction is given, and at the start of the processing, the image forming apparatus 1 conveys the sheet S at the first conveyance speed.

The power supply 95 supplies electric power to the heating element set 45 and the motor 69 (ACT 101). As a result, the heat generating portion of the heating element set 45 generates heat to heat the tubular film 35. The power generated by the power-supplied motor 69 is transmitted to the driving force transmission member 96, which rotates the pressure roller 30-2.

The current sensor 72 measures the drive current of the motor 69 (ACT 102). The current sensor 72 outputs information indicating the measurement result to the control unit 6. The control unit 6 determines whether or not the current value measured by the current sensor 72 and included in the information indicating the measurement result of the drive current of the motor 69 is equal to or greater than the threshold value (e.g., deceleration control threshold value, etc.) (ACT 103).

If it is determined that the current value is equal to or higher than the threshold value (e.g., deceleration control threshold value, etc.) (ACT 103: YES), the control unit 6 controls the rotation of various rollers so that the conveyance speed of the sheet S changes from the first conveyance speed to the second conveyance speed (ACT 104). This corresponds to the control unit 6 reducing the power supply to the motor 69 that rotationally drives the various rollers so that the conveyance speed of the sheet S changes from the first conveyance speed to the second conveyance speed. This control is executed before the sheet S is conveyed to the fixing device 30.

The control unit 6 outputs the notification as the alert at the same time as controlling the conveyance speed or after controlling the conveyance speed (ACT 105). The control unit 6 determines whether or not all printing is completed (ACT 106). If it is determined that all printing is completed (ACT 106: YES), the control unit 6 ends the processing. If the control unit 6 determines that all printing has not been completed (ACT 106: NO), the processes continues after ACT 101 is executed.

In the process of ACT 103, if it is determined that the current value is less than the threshold value (e.g., deceleration control threshold value, etc.) (ACT 103: NO), the control unit 6 determines whether or not all printing is completed (ACT 106).

According to the image forming apparatus 1 configured as described above, it is possible to prevent deterioration of quality. Specifically, the image forming apparatus 1 measures the drive current in the motor 69 for rotating the pressure roller 30-2 and controls the conveyance speed of the sheet S based on the measurement result. For example, the image forming apparatus 1 controls the conveyance speed to change from the first conveyance speed in a normal state to the second conveyance speed which is slower than the first conveyance speed so that the sheet S is conveyed at the second conveyance speed. As a result, it is possible to prevent the conveyance load generated if the sheet S is conveyed in the fixing device 30. Further, it is possible to reduce defects such as sheet wrinkles on the sheet S. As a result, it becomes possible to prevent deterioration of quality.

Further, the image forming apparatus 1 further outputs the notification as the alert if the current value is equal to or higher than the threshold value. As described above, even if the conveyance speed is controlled, if it is continuously used, the drive current in the motor 69 will increase, which may result in sheet wrinkles and damage of the tubular film 35. In the image forming apparatus 1, in addition to the conveyance speed control, an alert notification is performed.

As a result, service personnel can perform early inspections and repairs, which makes it possible to reduce downtime.

Second Embodiment

In the second embodiment, in a fixing device 30 having a mechanism capable of automatically adjusting and changing the pressing force, the configuration for adjusting the pressing force by using the measurement result of the drive current supplied to the motor 69 used to rotate the pressure roller 30-2 will be described. Since the basic configuration (for example, the configuration shown in FIGS. 1, 3, and 5) in the second embodiment is the same as that in the first embodiment, the description thereof will be omitted. Hereinafter, the differences from the first embodiment will be described.

In some scenarios, it is possible that a fixing failure may occur if the proper pressing force is not generated due to component defects, or if the proper pressing force is not generated due to the deterioration of the pressure roller 30-2 during its life. The life in the present embodiment means the deterioration or the degree of deterioration of the pressure roller 30-2. Life of the pressure roller 30-2 progresses as the number of uses and operating hours increase. In the past, the pressurization was adjusted based on a position measured by a position sensor. However, in the method using the position sensor, the pushing amount is constant. Therefore, the pressure drops due to the deterioration of the pressure roller 30-2 and the fixing member 30. For example, in some embodiment's, since the pressure roller 30-2 is composed of a sponge, the sponge may be worn away as it deteriorates, and if the pushing amount is constant, the pressing force may be insufficient.

Therefore, in the image forming apparatus 1 of the second embodiment, the pressing force is adjusted by controlling a mechanism that can automatically adjust and change the pressing force so that the measurement result of the drive current supplied to the motor 69 used to rotate the pressure roller 30-2 becomes the predetermined current value of the drive current (hereinafter referred to as "target current value"). As a result, in the image forming apparatus 1, the necessary pressure can be applied regardless of the deterioration, and thus, the fixing failure can be reduced.

Figure 7:
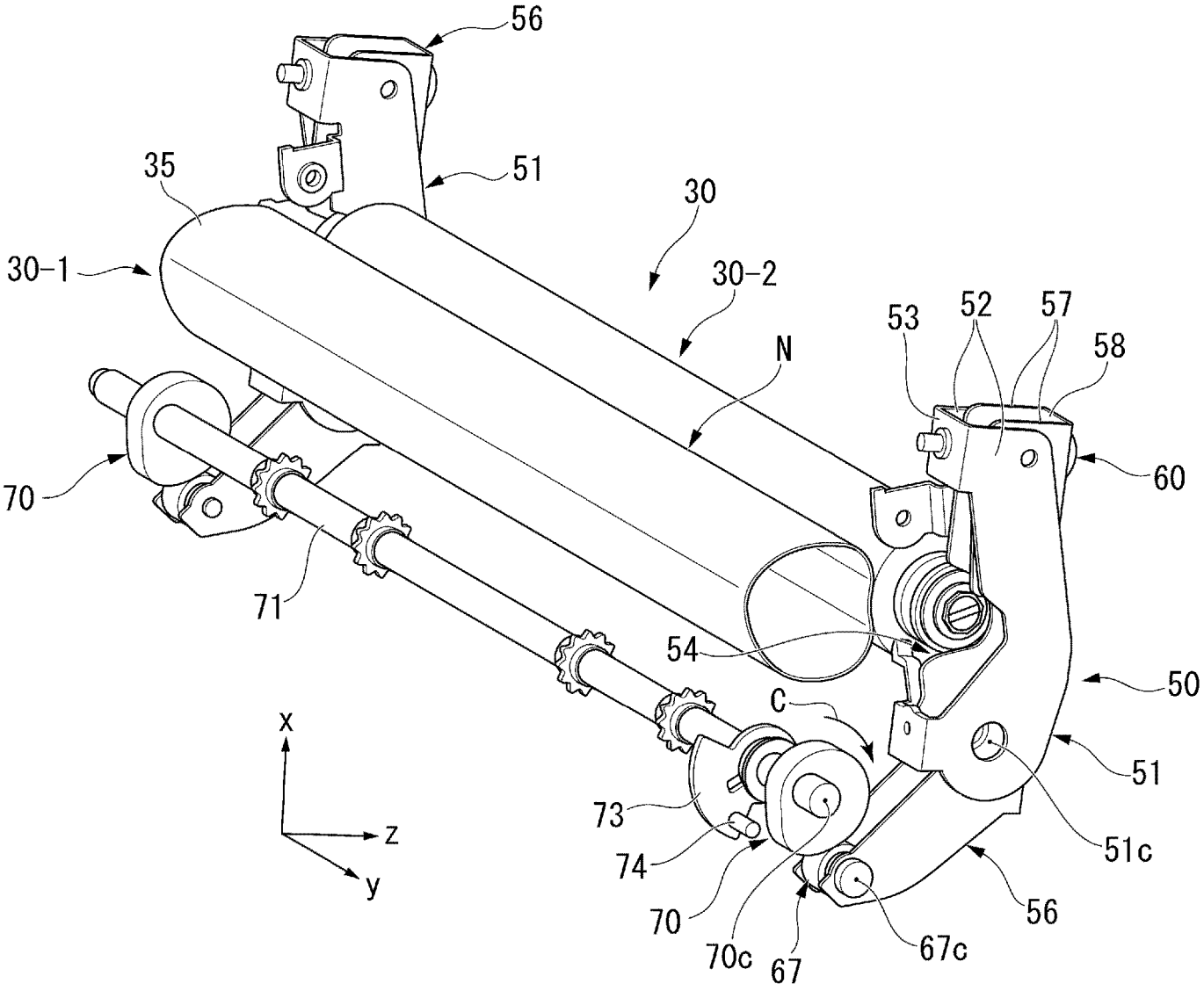
FIG. 7 is a perspective view of the image forming apparatus including a pressure roller moving mechanism, according to a second exemplary embodiment.
Figure 8:
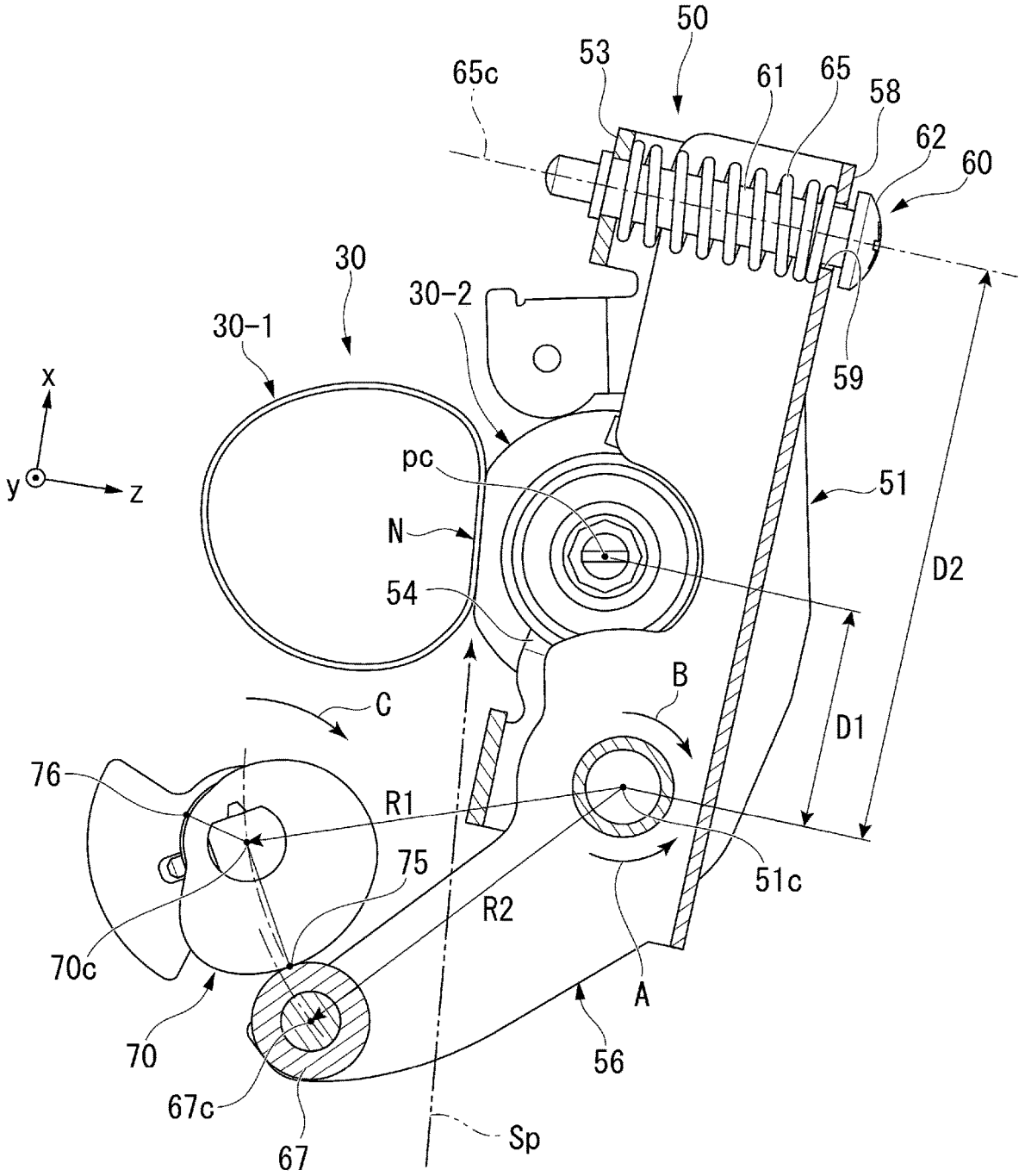
FIG. 8 is a side cross-sectional view of the pressure roller moving mechanism 50 according to FIG. 7.
Figure 9:
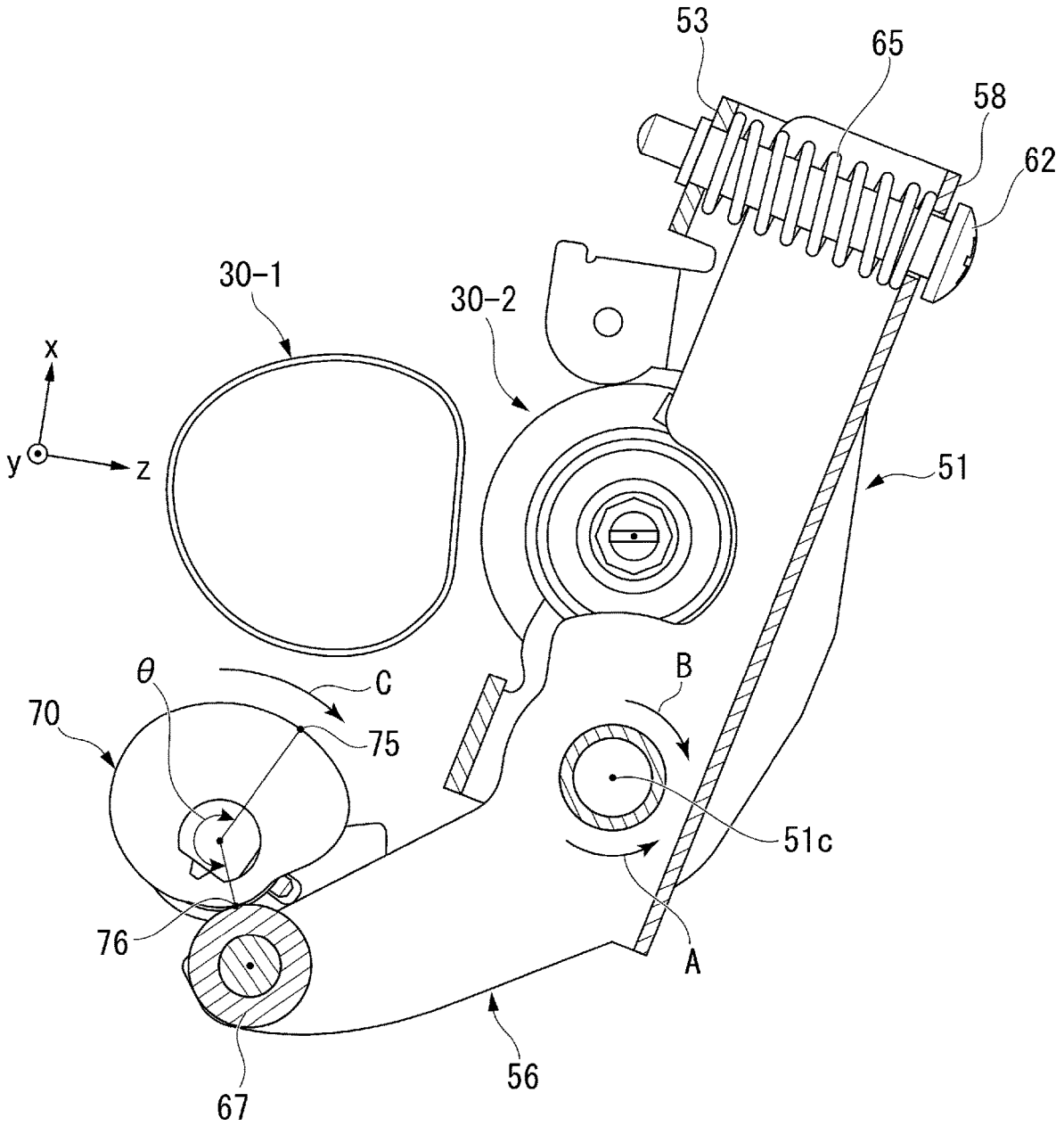
FIG. 9 is a side cross-sectional view of the pressure roller moving mechanism in a state in which a pressure roller is separated from a film unit, according to an exemplary embodiment.

FIGS. 7 to 9 will be used to describe the fixing device 30 having a mechanism that can automatically adjust and change the pressing force. FIG. 7 is a perspective view of the pressure roller moving mechanism 50 included in the image forming apparatus 1 in the second embodiment. Although this configuration is not directly related to the first embodiment, portions of the description of which have been omitted, the pressure roller moving mechanism 50 is a mechanism provided in the fixing device 30 in the first embodiment. In FIGS. 7 to 9, the description of the member inside the tubular film 35 is omitted.

The pressure roller moving mechanism 50 includes an arm 51, a pusher 56, a cam follower 67, and a cam 70. The constituent members of the pressure roller moving mechanism 50 are located at both ends of the pressure roller 30-2 in the y direction. The pressure roller moving mechanism 50 is plane-symmetrical with a x-z plane passing through the pressure roller rotation center pc of the pressure roller 30-2 in the y direction as a plane of symmetry. Hereinafter, the constituent members of the pressure roller moving mechanism 50 in the +y direction of the pressure roller 30-2 will be described.

The arm 51 has a length in the x direction. In some embodiments, the arm 51 may be formed of a steel plate material or the like. The arm 51 is rotatable around an arm rotation center 51*c*. The arm rotation center 51*c* is located near an end of the arm 51 in the −x direction and is parallel to the y direction.

The arm 51 includes arm body plates 52 and an arm connecting portion 53. The arm body plates 52 are parallel to the x-z plane. The pair of arm body plates 52 have an interval in the y direction. The arm body plate 52 in the −y direction includes a pressure roller support portion 54. The pressure roller support portion 54 is a semicircular notch at a center portion of the arm body plate 52 in the x direction and at an end portion in the −z direction. The pressure roller support portion 54 rotatably supports the pressure roller 30-2.

The arm connecting portion 53 connects the ends of the pair of arm body plates 52 in the −z direction to each other. The arm connecting portions 53 are located at both ends of the arm 51 in the x direction.

In some embodiments, the pusher 56 may be formed of a steel plate material or the like. The pusher 56 is rotatable around the arm rotation center 51*c*. The arm rotation center 51*c* is located in a middle portion of the pusher 56 in the x direction. One side of the pusher 56 has a length in the +x direction measured from the arm rotation center 51*c*. The other side of the pusher 56 has a length extending in the −x direction and the −z direction from the arm rotation center 51*c*.

The pusher 56 includes pusher main body plates 57 and a pusher connecting portion 58.

The pusher body plates 57 are parallel to the x-z plane. The pair of pusher body plates 57 has an interval (e.g., a space, gap, etc.) between the pair of pusher body plates 57 in the y direction. The pair of pusher body plates 57 are located inside the pair of arm body plates 52 in the y direction.

The pusher connecting portion 58 connects the ends of the pair of pusher body plates 57 in the +z direction to each other.

FIG. 8 is a side cross-sectional view of the pressure roller moving mechanism 50 included in the image forming apparatus 1 according to the second embodiment. The pressure roller moving mechanism 50 includes an elastic member 65. In some embodiments, the elastic member 65 may be a coil spring. The pressure roller 30-2 rotates around the pressure roller rotation center pc.

A pin 60 is at the end in the +x direction of the arm 51 and the pusher 56. The pin 60 extends in the z direction. The pin 60 includes a body portion 61 and a head portion 62.

In some embodiments, the body portion 61 has a round bar shape. A first end portion of the body portion 61 in the −z direction is fixed to the arm connecting portion 53 by screwing or the like. The body portion 61 has a length extending in the +z direction from the arm connecting portion 53 toward the pusher connecting portion 58. The pusher connecting portion 58 includes a through hole 59 having a diameter larger than that of the body portion 61. The body portion 61 is inserted through the through hole 59, and in some embodiments, extends through the through hole 59 in the +z direction towards the pusher connecting portion 58.

The head portion 62 is at a second end of the body portion extending in the +z direction. The head portion 62 has a larger diameter than the through hole 59.

An elastic member 65 is between the arm 51 and the pusher 56. More particularly, the elastic member 65 is located between the arm connecting portion 53 and the pusher connecting portion 58 in a compressed state. The elastic member 65 biases the arm 51 in a direction in which the pressure roller 30-2 abuts on the film unit 30-1. The elastic member 65 is coaxial with the body portion 61 of the pin 60.

In some embodiments, the elastic member 65 is on the same side (+x direction) as the pressure roller rotation center pc with respect to the arm rotation center 51*c*. A distance D2 from the arm rotation center 51*c* to the central axis 65*c* of the elastic member 65 is larger than a distance D1 from the arm rotation center 51*c* to the pressure roller rotation center pc. According to this configuration, the pressure roller 30-2 is pressed against the film unit 30-1 by a force larger than the biasing force of the elastic member 65.

The cam follower 67 is located at the end of the pusher 56 extending in the −x direction and the −z direction. In some embodiments, the cam follower 67 is a roller that can rotate around a cam follower rotation center 67*c* parallel to the y direction.

The cam 70 is adjacent to the cam follower 67 in the +x direction relative to the cam follower 67. A cam surface forming the contour of the cam 70 can come into contact with the outer peripheral surface of the cam follower 67. The pair of cams 70 at both ends of the pressure roller 30-2 in the y direction are connected by a camshaft 71. The camshaft 71 is rotationally driven by the motor 69 via a worm gear or the like. A fan-shaped member 73 is mounted on the camshaft 71. The cam 70 can rotate around a cam rotation center 70*c* in a direction indicated by arrow C. If the cam 70 is in contact with the cam follower 67 at a first position 75 and a second position 76, the sensor 74 detects both ends of the fan-shaped member 73 in the circumferential direction of the camshaft 71.

An operation of the pressure roller moving mechanism 50 according to an exemplary embodiment will be described.

If the fixing operation is performed by the fixing device 30, the pressure roller moving mechanism 50 brings the pressure roller 30-2 into contact with the film unit 30-1. FIG. 7 shows a state in which the pressure roller 30-2 is in contact with the film unit 30-1. The cam 70 is in contact with the cam follower 67 at the first position 75. The first position 75 is a contact position of the cam 70 with respect to the cam follower 67 if the pressure roller 30-2 and the film unit 30-1 are arranged in contact with each other. The first position 75 in the contour of the cam 70 is a position in the contour farthest from the cam rotation center 70*c*.

FIG. 9 is side cross-sectional view of the pressure roller moving mechanism 50 in a state in which the pressure roller 30-2 is separated from the film unit 30-1 in the second embodiment. The cam 70 is in contact with the cam follower 67 at the second position 76. The second position 76 is a contact position of the cam 70 with respect to the cam follower 67 if the pressure roller 30-2 and the film unit 30-1 are arranged in a separated state. The second position 76 in the contour of the cam 70 is a position in the contour having a distance to the cam rotation center 70*c* less than the first position 75.

The contact operation of the pressure roller 30-2 with the film unit 30-1 will be described according to an exemplary embodiment.

From the state of FIG. 8, the cam 70 rotates in the direction of the arrow C. The cam 70 pushes the cam follower 67 in the direction of arrow A. The pusher 56 that supports the cam follower 67 rotates around the arm rotation center 51*c* in the direction of arrow A. The pusher connecting portion 58 presses the arm connecting portion 53 in the −z direction via the elastic member 65. The arm 51 rotates around the arm rotation center 51*c* in the direction of arrow A in order to bring the pressure roller 30-2 into contact with the film unit 30-1.

Further, if the cam 70 rotates in the direction of arrow C, the pusher 56 rotates around the arm rotation center 51*c* in the direction of arrow A. The pusher connecting portion 58 is separated from the head portion 62 of the pin 60 to compress the elastic member 65. The elastic member 65 presses the arm connecting portion 53 in the −z direction. The arm 51 rotates around the arm rotation center 51*c* in the direction of arrow A. As in the state of FIG. 8, the pressure roller 30-2 is pressed by the film unit 30-1 to form the nip N, and the cam 70 abuts on the cam follower 67 at the first position 75.

The pusher 56 can rotate around the arm rotation center 51*c*. The centers of rotation (i.e., the arm rotation center 51*c*) of the pusher 56 and the arm 51 coincide with each other. If the pusher 56 rotates to compress the elastic member 65, the elastic member 65 is compressed along the central axis 65*c*. Interference between the through hole 59 of the pusher connecting portion 58 and the body portion 61 of the pin 60 is avoided. Such a structure stabilizes the operation of the pressure roller moving mechanism 50.

The operation of separating the pressure roller 30-2 from the film unit 30-1 will be described according to an exemplary embodiment.

From the state of FIG. 8, the cam 70 rotates in the direction of arrow C. The cam follower 67 approaches the cam rotation center 70*c* while moving relative to the contour of the cam 70. Due to a restoring force of the elastic member 65, the pusher 56 rotates around the arm rotation center 51*c* in the direction of arrow B. A distance between the pusher connecting portion 58 and the arm connecting portion 53 is widened, and the compression of the elastic member 65 is relaxed. The arm 51 rotates around the arm rotation center 51*c* in the direction of arrow B due to a decrease in the pressing force of the arm connecting portion 53 by the elastic member 65 and the restoring force of the pressure roller 30-2.

Further, if the cam 70 rotates in the direction of arrow C, the pusher 56 rotates around the arm rotation center 51*c* in the direction of arrow B. The pusher connecting portion 58 abuts on the head portion 62 of the pin 60, and the distance between the pusher connecting portion 58 and the arm connecting portion 53 is fixed. The arm 51, together with the pusher 56, rotates around the arm rotation center 51*c* in the direction of arrow B. As in the state of FIG. 9, the pressure roller 30-2 is separated from the film unit 30-1, and the cam 70 abuts on the cam follower 67 at the second position 76.

Figure 10:
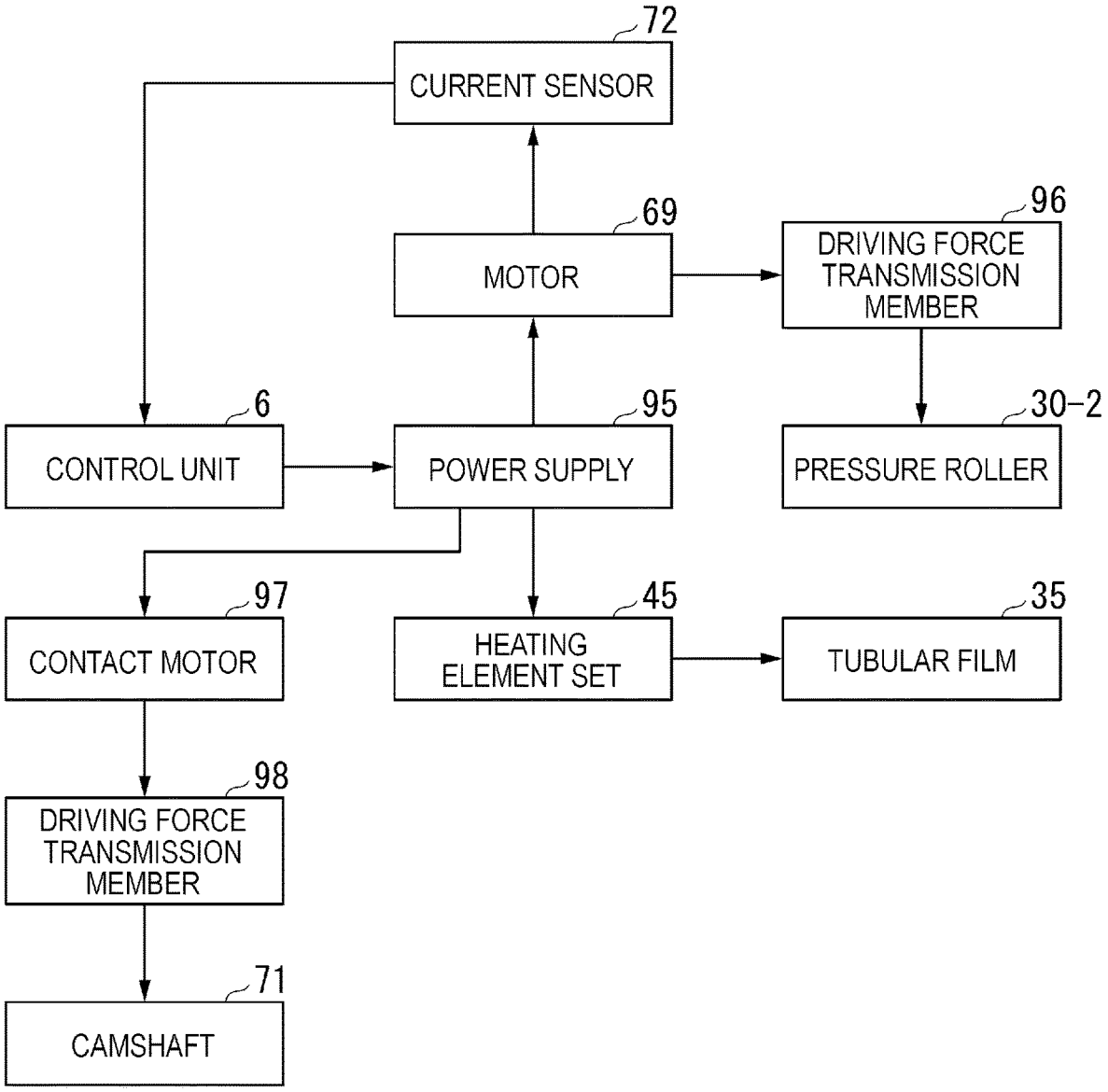
FIG. 10 is a block diagram showing a pressurization control by the fixing device.

FIG. 10 will be used to describe a pressurization control by the fixing device 30 in the second embodiment. FIG. 10 is a block diagram showing a pressurization control by the fixing device 30. Additionally, in FIG. 10, the same configuration as that described in FIG. 3 will be omitted.

The power supply 95 supplies electric power to the contact motor 97 in addition to the heating element set 45 and the motor 69. The power generated by the power-supplied contact motor 97 is transmitted to the driving force transmission member 98. The driving force transmission member 98 is, for example, a worm gear.

The driving force transmission member 98 converts the power transmitted from the contact motor 97 into a rotational force that rotates the camshaft 71 and rotates the camshaft 71. A rotational force is applied to the camshaft 71 from the driving force transmission member 98, and the camshaft 71 is rotationally driven, for example, clockwise at a predetermined speed. The rotation of the camshaft 71 causes the cam 70 to rotate, and the cam 70 pushes the cam follower 67 in the direction of arrow A shown in FIG. 8. As a result, the pressure roller 30-2 is brought into contact with the film unit 30-1.

The control unit 6 acquires information indicating the measurement result of the drive current of the motor 69 output from the current sensor 72. The control unit 6 drives the contact motor 97 so that the drive current to the motor 69 becomes the target current value based on the information indicating the measurement result of the drive current of the motor 69. The target current value is a value required for applying an appropriate pressure to the sheet S in the fixing device 30. The target current value is set in advance.

Figure 11:
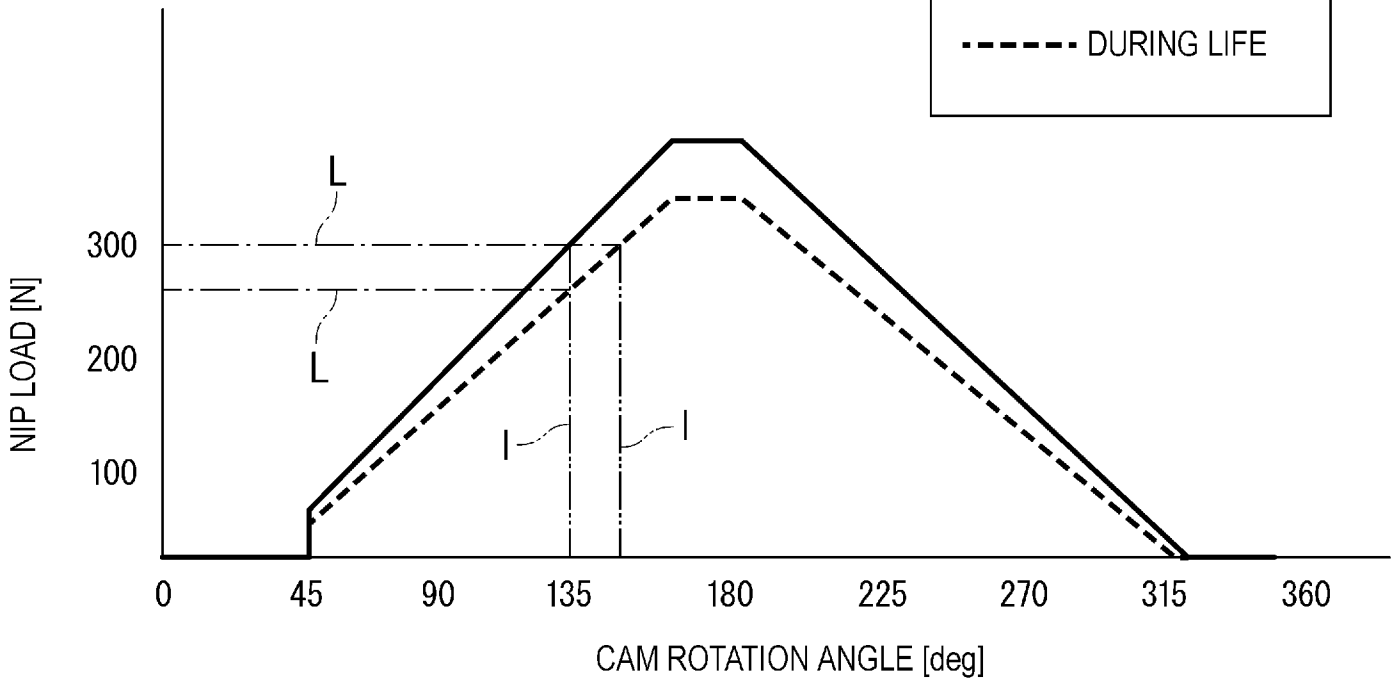
FIG. 11 is a diagram showing a relationship between the rotation of a cam and a nip load.

In this way, the pressing force can be increased by rotating the cam 70 by driving the contact motor 97. FIG. 11 is a diagram showing a relationship between the rotation of the cam 70 and the nip load. In FIG. 11, the horizontal axis represents the rotation angle (deg) of the cam 70, and the vertical axis represents the nip load (Newtons). As shown in FIG. 11, the nip load according to the rotation angle of the cam 70 differs between the pressure roller 30-2 at the time of a new product and the pressure roller 30-2 which has deteriorated. As described above, since the pressure roller 30-2 is composed of a sponge, the sponge wears out upon deterioration, and in order to obtain the same nip load as a new product, the rotation angle of the cam 70 needs to be increased.

In the method using the conventional position sensor, the contact motor 97 is controlled by detecting that the rotation angle of the cam 70 reached a preset angle. Therefore, as shown by the two dashed lines l of FIG. 11, the nip load drops during life. For example, if the preset angle is 135 (deg), a nip load of 300 (Newtons) is obtained if the product is new, but if deterioration occurs due to an increase in the number of uses, a nip load of 300 (Newtons) cannot be obtained.

On the other hand, in the image forming apparatus 1 in the second embodiment, the contact motor 97 is controlled by detecting that the drive current reached the target current value, not the rotation angle of the cam 70. If the target current value is the value of the drive current of the motor 69 if an appropriate pressing force is applied in the state before deterioration of the pressure roller 30-2 (for example, the state if the product is new), even if the pressure roller 30-2 deteriorated, the rotation angle of the cam 70 is increased so that the value of the drive current of the motor 69 becomes the target current value, and thus, the load of the pressure roller 30-2 can be kept at the same level as that before deterioration, as shown by the two dashed lines L of FIG. 11.

Figure 12:
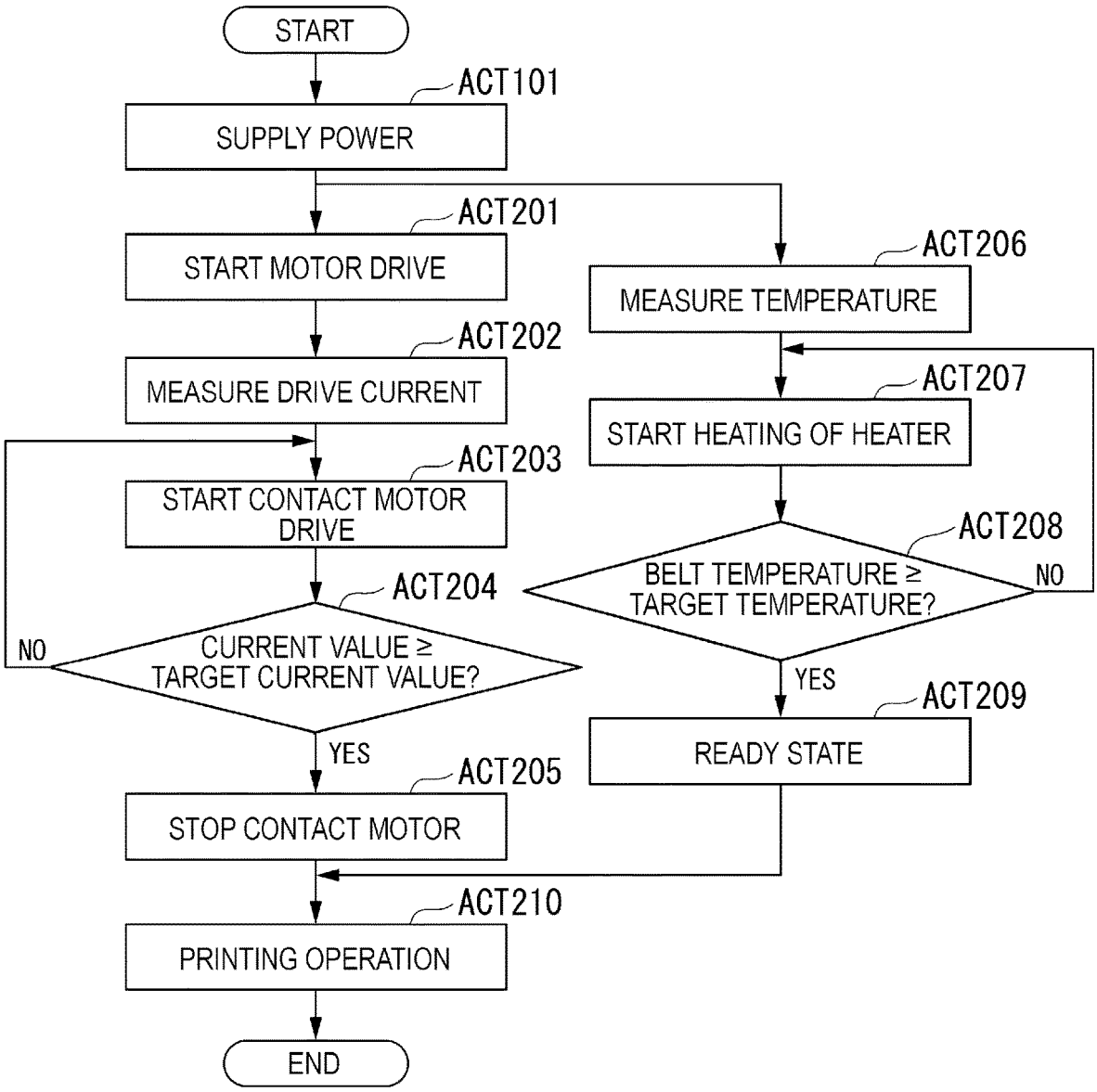
FIG. 12 is a flowchart depicting a method for controlling the image forming apparatus, according to an exemplary embodiment.

FIG. 12 is a flowchart depicting a method for controlling the image forming apparatus 1 in the second embodiment. The processing of FIG. 12 is executed if a printing instruction is given. In FIG. 12, the same reference numerals as in FIG. 6 are denoted for the same processes as FIG. 6 and the descriptions thereof will be omitted.

If the process in ACT 101 is completed, the processes from ACT 201 to ACT 205 and the processes from ACT 206 to ACT 209 are executed in parallel in the image forming apparatus 1. In the following, for convenience of explanation, the processes from ACT 201 to ACT 205 are described first, and then an example will be described in which the processes from ACT 206 to ACT 209 are executed. The motor 69 is driven by the electric power supplied from the power supply 95 (ACT 201). As a result, the pressure roller 30-2 is rotationally driven.

The current sensor 72 measures the drive current of the motor 69 (ACT 202). The current sensor 72 outputs information indicating the measurement result to the control unit 6. In the following description, the current sensor 72 periodically measures the drive current of the motor 69 and outputs information indicating the measurement result to the control unit 6. The power supply 95 supplies electric power to the contact motor 97 in response to the instruction from the control unit 6. The contact motor 97 is driven by the electric power supplied from the power supply 95 (ACT 203). As the contact motor 97 continues to be driven, the rotation angle of the cam 70 increases. As a result, the pressure roller 30-2 is brought into contact with the tubular film 35, and pressure is applied to the tubular film 35 from the pressure roller 30-2.

The control unit 6 determines whether or not the current value included in the information indicating the measurement result of the drive current of the motor 69 measured by the current sensor 72 is equal to or higher than the target current value (ACT 204). If it is determined that the current value is equal to or higher than the target current value (ACT 204: YES), the control unit 6 stops the power supplied from the power supply 95 to the contact motor 97, whereby stopping the drive of the contact motor 97 (ACT 205). As the drive of the contact motor 97 stops, the rotation of the cam 70 also stops. As a result, the state in which an appropriate pressing force is applied is kept.

In the process of ACT 204, if the control unit 6 determines that the current value is less than the target current value (ACT 204: NO), the control unit 6 returns to the process of ACT 203 and continues to drive the contact motor 97.

Next, the processes from ACT 206 to ACT 209 will be described. The heater thermometer 46 measures a temperature of the heater unit 40. The heater thermometer 46 outputs a temperature measurement result to the control unit 6. The film thermometer 64 measures a temperature of the tubular film 35 (ACT 206). The film thermometer 64 outputs a temperature measurement result to the control unit 6. In the following description, the heater thermometer 46 and the film thermometer 64 are assumed to periodically measure the temperature and output information indicating the measurement results to the control unit 6.

The heating element set 45 heats the tubular film 35 using the electric power supplied from the power supply 95 (ACT 207). The control unit 6 determines whether or not the temperature (e.g., the belt temperature, etc.) of the tubular film 35 measured by the film thermometer 64 is equal to or higher than the target temperature (ACT 208). A target temperature is the temperature of the tubular film 35 suitable for performing the fixing process. If it is determined that the temperature (e.g., the belt temperature, etc.) of the tubular film 35 measured by the film thermometer 64 is less than the target temperature (ACT 208: NO), the control unit 6 continues heating of the tubular film 35.

If it is determined that the temperature (e.g., the belt temperature, etc.) of the tubular film 35 measured by the film thermometer 64 is equal to or higher than the target temperature (ACT 208: YES), the control unit 6 determines that the ready state was reached. If the processes of ACT 205 and ACT 209 are completed, the image forming apparatus 1 executes printing (ACT 210).

According to the image forming apparatus 1 in the second embodiment configured as described above, it is possible to reduce fixing failures. Specifically, in the image forming apparatus 1 in the second embodiment, the pressing force is adjusted so that the current value supplied to the motor 69 becomes the target current value. Therefore, an appropriate pressure can be applied from the pressure roller 30-2 to the film unit 30-1 regardless of deterioration. Therefore, it is possible to reduce fixing failures.

Hereinafter, a modification of the image forming apparatus 1 in the second embodiment will be described.

In the above-mentioned configuration, the configuration using the film unit 30-1 is shown as the configuration of the fixing device 30. In the image forming apparatus 1 in the second embodiment, a combination of the pressure roller 30-2 and the heat roller may be used as the configuration of the fixing device 30.

The following appendices are disclosed with respect to the image forming apparatus 1 shown in the present embodiment.

(Appendix 1)

An image forming apparatus including:

a sheet storage for storing sheets;

a sheet feed roller for feeding the sheet stored in the sheet storage into a conveyance path;

an image forming device for forming an image on the sheet conveyed to the conveyance path;

a fixing device including a pressure roller rotationally driven by a motor and a pressure adjusting mechanism for adjusting pressure applied by the pressure roller, wherein the fixing device fixes the image formed on the sheet, a sensor for measuring a drive current in the motor, and a controller including a processor configured to control the pressure adjusting mechanism so that the drive current in the motor becomes a target current value based on the measured drive current.

(Appendix 2)

In the image forming apparatus according to Appendix 1, wherein the processor is further configured to control the pressure adjusting mechanism so that the drive current in the motor becomes the target current value, in response to determining a value of the drive current is less than the target current value.

(Appendix 3)

In the image forming apparatus according to Appendix 1, the pressure adjusting mechanism includes a contact motor for adjusting the pressure applied by the pressure roller, and the processor is further configured to increase the pressure applied by the pressure roller by increasing electric power supplied to the contact motor.

Some functions of the image forming apparatus 1 in the above-described embodiment may be implemented by a computer. In that case, the program for implementing this function is recorded on a computer-readable recording medium. Then, the function may be implemented by reading the program recorded on the recording medium on which the above-mentioned program was recorded into a computer system and executing the program.

The "computer system" here includes operating systems or hardware such as peripheral devices. Further, the "computer-readable recording medium" refers to a portable medium, a storage device, or the like. The portable medium is a flexible disk, a magneto-optical disk, a ROM, a CD-ROM, or the like. The storage device is a hard disk or the like built in a computer system. Further, the "computer-readable recording medium" is a medium that dynamically stores a program for a short period of time, such as a communication line if a program is transmitted via a communication line. The communication line is a network such as the Internet, a telephone line, or the like. Further, the "computer-readable recording medium" may be a volatile memory inside a computer system serving as a server or a client. The volatile memory stores a program for a certain period of time. Further, the above program may be for implementing a part of the above-mentioned functions. Further, the above-mentioned program may further implement the above-mentioned functions in combination with a program already recorded in the computer system.

While certain embodiments have been described, these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a sheet storage configured to store sheets;

a sheet feed roller configured to feed a sheet stored in the sheet storage into a conveyance path;

an image forming device configured to form an image on the sheet conveyed to the conveyance path;

a fixing device configured to fix the image formed on the sheet and including a fixing belt and a pressure roller abutting on an outside of the fixing belt, the fixing belt being a strip-shaped thin film;

a motor configured to drive and rotate the fixing belt by rotating the pressure roller;

a sensor configured to measure a drive current in the motor; and a controller including a processor configured to control a conveyance speed of the sheet based on the measured drive current.

2. The apparatus according to claim 1, wherein the processor is further configured to control, in response to determining a drive current value corresponding to the measured drive current is equal to or greater than a threshold value, the conveyance speed to change from a first conveyance speed in a normal state to a second conveyance speed, the second conveyance speed being slower than the first conveyance speed, such that the sheet is conveyed at the second conveyance speed.

3. The apparatus according to claim 2, wherein the processor is further configured to output a notification as an alert in response to determining the drive current value is equal to or greater than a threshold value.

4. The apparatus according to claim 3, wherein the processor is further configured to transmit a signal to an external device via a network as the notification of the alert.

5. The apparatus according to claim 3, further comprising:

a display configured to display information, wherein the processor is further configured to cause the display to display information on a call guidance as the notification of the alert.

6. The apparatus according to claim 2, further comprising:

a plurality of rollers configured to convey the sheet, the plurality of rollers being driven by the motor, wherein the processor is further configured to reduce, relative to a power supply to the motor in the normal state, the power supply to the motor such as to convey the sheet at the second conveyance speed.

7. The apparatus according to claim 1, wherein the processor is further configured to control the conveyance speed before the sheet reaches the fixing device.

8. The apparatus according to claim 1, wherein the fixing belt is configured to slide on a surface of a heating element set while contacting the heating element set and pressurize the sheet, the heating element set including a heating element for generating heat via a lubricant.

9. The apparatus according to claim 2, wherein the second conveyance speed is less than or equal to approximately 50 percent of the first conveyance speed.

10. The apparatus according to claim 1, wherein the motor is a brushless Direct Current (DC) motor.

11. A method for controlling an image forming apparatus having a processor, the method comprising:

measuring, by a sensor, a drive current to a motor;

controlling, by the processor, a conveyance speed based on the measured drive current;

feeding, by a sheet feed roller, a sheet stored in a sheet storage into a conveyance path;

driving and rotating, by the motor, a fixing belt by rotating a pressure roller abutting on an outside of the fixing belt, the fixing belt being a strip-shaped thin film;

forming an image on the sheet conveyed to the conveyance path; and fixing, by the fixing belt and the pressure roller, the image formed on the sheet.

12. The method of claim 11, further comprising:

controlling, in response to determining a drive current value corresponding to the measured drive current is equal to or greater than a threshold value, the conveyance speed to change from a first conveyance speed in a normal state to a second conveyance speed, the second conveyance speed being slower than the first conveyance speed.

13. A non-transitory computer readable medium configured to store instructions, which, when executed by a processor, cause operations to be carried out, the operations comprising:

measuring, by a sensor, a drive current to a motor;

controlling, by the processor, a conveyance speed based on the measured drive current;

feeding, by a sheet feed roller, a sheet stored in a sheet storage into a conveyance path;

driving and rotating, by the motor, a fixing belt by rotating a pressure roller abutting on an outside of the fixing belt, the fixing belt being a strip-shaped thin film;

forming an image on the sheet conveyed to the conveyance path; and fixing, by the fixing belt and the pressure roller, the image formed on the sheet.

* * * * *